United States Patent [19]

Lundberg

[11] 4,049,313

[45] Sept. 20, 1977

[54] LOCKING RECEPTACLE FOR ELECTRIC METER BOX OR THE LIKE

[75] Inventor: George A. Lundberg, Pompton Lakes, N.J.

[73] Assignee: E. J. Brooks Company, Newark, N.J.

[21] Appl. No.: 648,193

[22] Filed: Jan. 12, 1976

[51] Int. Cl.[2] ..... E05C 19/18; B65D 33/34

[52] U.S. Cl. ..... 292/307 R; 292/252; 70/159

[58] Field of Search ..... 70/159, 34, 371; 292/252, 307, 327

[56] References Cited

U.S. PATENT DOCUMENTS

| | | | |
|---|---|---|---|
| 1,956,438 | 4/1934 | Eichenauer | 70/371 X |
| 2,016,797 | 10/1935 | Burns et al. | 292/307 R X |
| 2,113,744 | 4/1938 | Pixley et al. | 292/307 R X |
| 3,296,842 | 1/1967 | Auerbach et al. | 70/371 X |
| 3,714,802 | 2/1973 | Morse et al. | 70/34 |

*Primary Examiner*—Richard E. Moore
*Attorney, Agent, or Firm*—Robert E. Ross

[57] ABSTRACT

A locking structure for assembly onto existing electric meter boxes or the like, said structure comprising a bushing for mounting onto the box cover and an apertured bracket for mounting inside the box so that the bracket aperture is aligned with the bushing. The structure is intended to receive a locking cylinder of the type having an enlarged head and an elongated body portion with expansible locking balls near the end remote from the head, and the parts are dimensioned and positioned to retain the cover tightly closed when the locking cylinder is assembled. The bushing completely encloses the head of the locking cylinder so that the other end of the cylinder is recessed in the bushing. Apertures may be provided in opposite sides of the forward end of the bushing to receive a seal transversely across the bushing, so that the locking member cannot be removed without rupturing the seal.

4 Claims, 5 Drawing Figures

Fig. 1
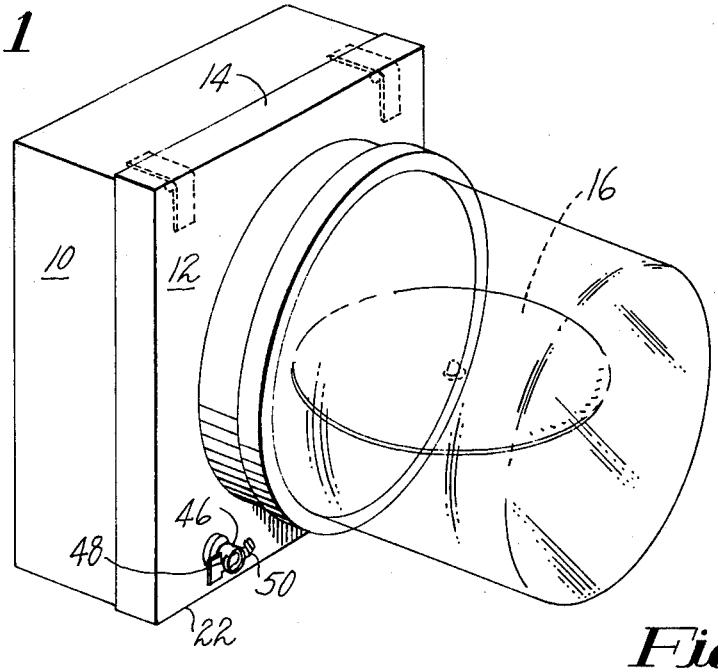
Fig. 2
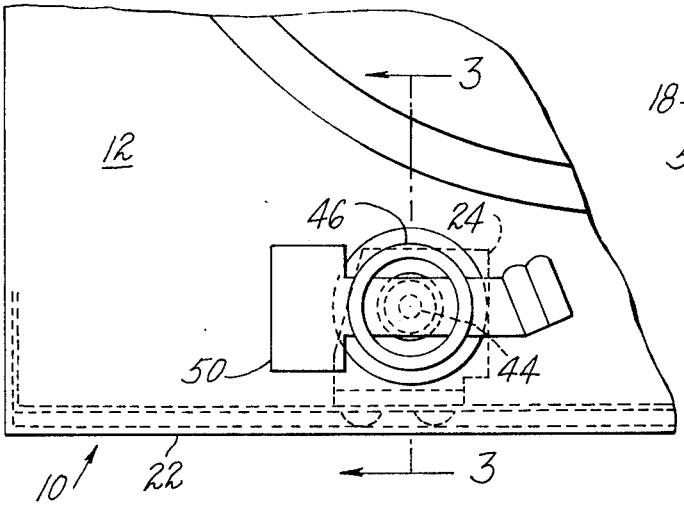
Fig. 3
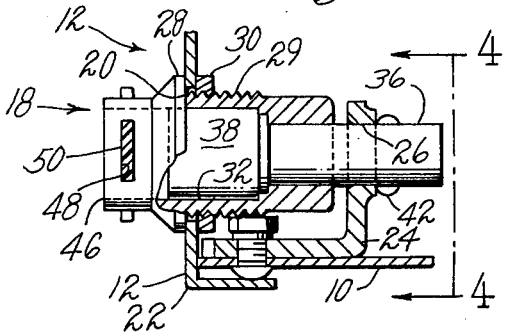
Fig. 4
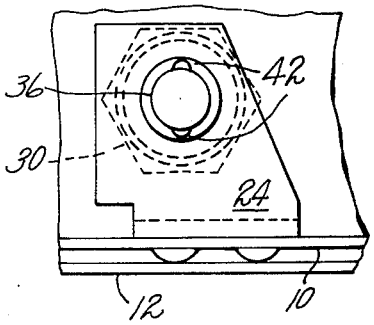
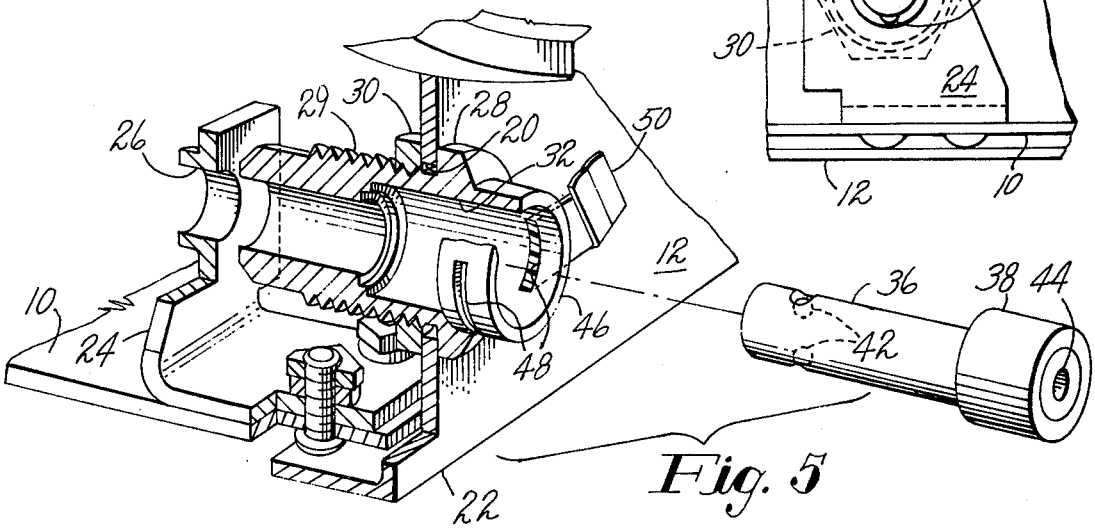
Fig. 5

LOCKING RECEPTACLE FOR ELECTRIC METER BOX OR THE LIKE

BACKGROUND OF THE INVENTION

Many types of boxes enclosing electric meters have in the past been retained closed by a releasable latch and a seal such as a lead and wire seal or a metal strap which must be broken to open the box cover.

With increasing vandalism and removal of meters by unauthorized persons to gain access to the power terminals to short out the meter, it has become apparent that the customary means of sealing meter boxes is inadequate. However, to completely replace the boxes with a more secure type would be unduly expensive.

SUMMARY OF THE INVENTION

To convert an ordinary meter box into a more tamper-resistant closure, the box is provided with a bushing in the cover and an apertured bracket inside the housing, positioned to be aligned with the bushing.

The bushing and bracket are dimensioned and positioned to receive a locking cylinder of the type having an enlarged head and an elongated body with expansible locking balls near the end of the body opposite the head.

The bushing is provided with means for attachment into a suitably positioned opening in the cover of the box. A central opening in the bushing has a rear portion sized to closely fit the cylindrical body and a larger forward portion sized to closely fit the enlarged head of the cylinder.

The bracket and the bushing are so positioned in relation to each other that when the cover is closed, the locking cylinder may be inserted through the bushing and the bracket aperture, and the locking balls expanded into the locking position behind the bracket. The bushing and the bracket thereafter prevent axial movement of the locking cylinder in either direction, and, in cooperation with the locking cylinder, maintain the cover in the locked condition. The bushing is dimensioned to protrude forwardly from the cover and extend forwardly beyond the outer surface of the head of the locking member.

The outermost portion of the bushing may be provided with apertures in opposing portions to receive a seal transversely across the bushing opening, to thereby prevent removal of the locking device without breaking the seal.

BRIEF DESCRIPTION OF THE DRAWING

FIG. 1 is a view in section partly in elevation of a meter box having a locking assembly embodying the features of the invention.

FIG. 2 is an enlarged front plan view of a portion of the assembly of FIG. 1.

FIG. 3 is a view in section taken on line 3—3 of FIG. 2.

FIG. 4 is a view in section taken on line 4—4 of FIG. 3.

FIG. 5 is a perspective view, partly broken away of the assembly of FIGS. 2–4, with the locking member positioned for insertion.

DESCRIPTION OF THE ILLUSTRATED EMBODIMENTS

Referring to FIGS. 1–3 of the drawing there is illustrated a meter box comprising a housing 10 and a cover

12 hinged to the housing at one edge 14. The housing 10 is adapted to receive an electric meter 16 or the like.

To provide means for locking the cover to the housing to prevent access to the meter by unauthorized persons, a bushing 18 is assembled into a suitable aperture 20 in the cover positioned near the edge 22 thereof opposite the hinged edge, and a bracket 24 having aperture 26 is mounted onto an inner wall of the box so that the aperture 26 therein is aligned with the axis of the bushing 18.

The bushing 18 has an outer enlarged head 28 for bearing against the outer surface of the cover of the box and a cylindrical threaded portion 29 for extending through the cover opening, receiving a nut 30 for clamping the bushing to the cover.

The bushing 18 has an aperture therethrough having an enlarged outer portion 32 and a smaller inner portion 34.

The bushing 18 and the bracket 24 are dimensioned and positioned to receive a locking member 36 of the type having an enlarged head 38 and an elongated cylindrical portion 40 with expansible locking balls 42 near the end thereof remote from the head. The locking member 36 may be of the type shown in U.S. Pat. No. 3,002,368 and is operable as described in said patent, by a suitable tool inserted into an opening 44 in the head 38.

In the illustrated embodiment of the invention the bushing 18 is provided with a collar 46 which projects from the outer portion 28 thereof about the aperture portion 32, so that the head 38 of an assembled locking member is recessed within the collar 46.

Apertures 48 are provided in opposite portions of the collar 46 to receive a seal 50 across the opening outsude of the head of the assembled locking member. The seal 50 is of the type that must be destroyed to remove the locking member, and will give evidence of unauthorized tampering with the assembly.

The bushing 18 and bracket 24 may, of course, be assembled with a meter box during manufacture; however, they may also be utilized to convert a previously installed meter box to a locking box.

In the latter case a suitable template may be provided to indicate the proper position for making the opening in the cover to receive the bushing and the openings in the wall of the box to receive the fasteners for the bracket.

After the components are assembled with the box, the cover of the box is closed and the locking member inserted into the bushing aperture until the head 38 thereof seats in the larger aperture portion 32 of the bushing, which position the other end of the locking member extends through the aperture 26 of the bracket, with the locking balls 42 disposed just beyond the remote side of the bracket. The mechanism of the locking member may then be operated to expand the balls into a locking position, thereby locking the cover closed.

The seal 50 may thereafter be assembled through the apertures 48.

As pointed out above, the bushing and bracket may be installed in the meter box during manufacture thereof, or may be provided in kit form, with a suitable template, for assembly with previously installed meter boxes. The configuration and method of mounting of the bracket can, of course, be varied to suit the particular meter box configuration.

Since certain changes apparent to one skilled in the art may be made in the illustrated embodiment of the invention without departing from the scope thereof, it is intended that all matter contained herein be interpreted in an illustrative and not a limiting sense.

I claim:

1. In an electric meter box having an open side and a cover for said open side hinged to the box at one edge, an assembly for receiving a locking member of the type having an enlarged head at one end and an elongated body with expansible locking projections near the other end, said assembly comprising a bushing mounted (for mounting) in said cover near the edge opposite said hinged edge, said bushing having an aperture with an outer portion sized to receive the enlarged head of the locking member and an inner portion sized to receive the body of the locking member and a bracket mounted in the housing, said bracket having an aperture aligned with the bushing aperture to receive the end of the body of the locking member and being so positioned that the locking projections can lock behind the bushing when the cover is tightly closed, the end of the body extending sufficiently far beyond the rear of the bracket that the cover cannot be opened without removal of the locking member from said bracket.

2. An assembly as set forth in claim 1 in which the bushing has a forwardly projecting wall disposed about the outer end of the outer portion of the bushing aperture, whereby the outer end of an assembled locking member is recessed within the wall, said wall having a pair of openings in opposite portions thereof to receive a seal so that a portion of the seal extends transversely between the wall portions beyond the end of said locking member.

3. An electric meter box, comprising a housing having an open side and a cover for the open side hinged to the box at one edge, a bushing mounted in said cover near the edge opposite the hinged edge, said bushing having a shouldered aperture extending therethrough to receive the head end of a locking member of the type having an enlarged head at one end and expansible locking balls near the other end, a bracket assembled in the housing, said bracket having an aperture aligned with the aperture in the bushing to receive said other end of the locking member so that the balls lock on the inner side of said bracket, said bushing and said bracket being so dimensioned and positioned that the outermost surface of the assembled locking member is recessed within said bushing, said bushing having a pair of transverse apertures to be outwardly of the head of an assembled locking member to allow a seal to be assembled therein so as to extend across the opening, whereby said locking member cannot be removed without breaking the seal, the locking member extending sufficiently far beyond the bracket so that the cover cannot be opened without removal of the end of the locking member from the bushing.

4. A bushing for assembly into the cover of a meter box or the like to cooperate with an apertured bracket mounted in the box to receive a locking member of the type having an enlarged head, an elongated body portion and expansible locking lugs positioned in the body portion near the end thereof opposite the head, said lugs being operable between a locking and a non-locking position by a tool inserted into a tool aperture in the outer end of the head, said bushing comprising a head having a flange for seating against the outer face of the cover, a body projecting rearwardly therefrom for passing through an aperture in the cover, and means for securing the bushing to the cover, said bushing having an internal aperture with an enlarged outer portion dimensioned to receive the enlarged head of the locking member and an inner portion dimensioned to receive the elongated body portion and a wall portion projecting forwardly from the head, around the opening so dimensioned that the outer end of the enlarged head of an assembled locking member is rescessed within the wall, said wall having opposing apertures to receive a seal so that a portion thereof extends between said opposing apertures to prevent removal of the locking member without destroying the seal.

* * * * *